US005543827A

United States Patent [19]

VanSteenkiste et al.

[11] Patent Number: 5,543,827

[45] Date of Patent: Aug. 6, 1996

[54] INK JET PRINT HEAD NOZZLE CLEANING COINCIDING WITH NOZZLE VIBRATION

[75] Inventors: Roger C. VanSteenkiste; David G. VanSteenkiste, both of Gilbert, Ariz.

[73] Assignee: Fas-Co Coders, Inc., Chandler, Ariz.

[21] Appl. No.: 225,551

[22] Filed: Apr. 11, 1994

[51] Int. Cl.[6] ..... B41J 2/165

[52] U.S. Cl. ..... 347/27; 347/28; 347/85; 347/92

[58] Field of Search ..... 347/22, 23, 25, 347/26, 27, 28, 30, 35, 60, 92, 85; 134/1

[56] References Cited

U.S. PATENT DOCUMENTS

| | | | |
|---|---|---|---|
| 4,528,996 | 7/1985 | Jones | 347/28 |
| 4,540,997 | 9/1985 | Biggs et al. | 347/28 |
| 4,589,000 | 5/1986 | Koto et al. | 347/30 X |
| 4,609,925 | 9/1986 | Nozu et al. | 347/27 |
| 4,851,863 | 7/1989 | Yamamori et al. | 347/28 |
| 4,959,662 | 9/1990 | Kobayashi | 347/25 |

FOREIGN PATENT DOCUMENTS

| | | | |
|---|---|---|---|
| 57-022063 | 2/1982 | Japan | 347/28 |
| 58-98563 | 6/1983 | Japan | 347/28 |
| 59-12857 | 1/1984 | Japan | 347/28 |
| 61-193857 | 2/1986 | Japan | 347/28 |

*Primary Examiner*—John E. Barlow, Jr.
*Attorney, Agent, or Firm*—Thomas R. Lampe

[57] ABSTRACT

Apparatus and method for periodically applying liquid solvent to the outer surface of a nozzle plate of an ink jet nozzle to clean ink jet nozzle openings at the nozzle plate outer surface. Flow of the liquid solvent along the nozzle plate outer surface is under the influence of gravity. Energization of piezoelectric crystals to vibrate the ink jet nozzle promotes liquid solvent flow.

7 Claims, 2 Drawing Sheets

INK JET PRINT HEAD NOZZLE CLEANING COINCIDING WITH NOZZLE VIBRATION

TECHNICAL FIELD

This invention relates to ink jet nozzles of the type employed to apply a code or other ink indicia to an object. More particularly, the invention encompasses an apparatus and a method for cleaning an ink jet nozzle at the ink jet exit openings through which ink is expressed when directing ink toward an object.

BACKGROUND ART

A conventional ink jet nozzle for directing ink toward an object to apply inked indicia to the object includes a nozzle plate having an outer surface and a plurality of ink jet openings at the outer surface defined by the ink jet nozzle through which ink is expressed when applying the code or other indicia.

The means for expressing the ink through the ink jet exit openings can vary; however, a relatively commonly employed approach is to employ piezoelectric crystals in operative association with ink feeder tubes leading to the ink jet exit openings. By selectively applying an electrical current to one or more of the piezoelectric crystals, a quantity of ink is expressed or squirted toward an object through selected ink jet exit openings and the desired ink jet pattern is formed.

Ink is expressed through the nozzle on a periodic basis in a system such as that just described and which is known in the art as a "drop on demand" system. Suitable sensing means is normally incorporated in such a system to sense when an object is in position to have a code or other indicia applied thereto.

Over time an inky crust can build up on the nozzle plates of drop on demand ink jet nozzles and the ink jet exit openings can and do become partially or fully clogged or blocked at the nozzle plate. This is aggravated by the fact that ink jet nozzles are often operating under elevated temperatures. Because of this problem, the users of drop on demand systems are often limited as to the types of inks which can be utilized in the nozzles. With prior art ink jet nozzle approaches, an attempt is made to at least slow down the blocking or clogging of the exit openings by employing only relatively light, slow drying inks. In other words, existing approaches can preclude the use of thicker and darker inks which dry faster and shoot further. Thinner, lighter inks are, however, more likely to run or smear on objects to which codes or other indica are applied.

As indicated above, even thinner, lighter inks can cause exit opening obstruction. Consequently, it has been a common practice to occasionally apply liquid solvent to the nozzle plate in the vicinity of the ink jet exit openings manually, typically by wiping the nozzle plate with a cloth impregnated with liquid solvent. This is not satisfactory. First of all, such an approach relies upon an individual to perform the cleaning task responsibly and reliably on a regular basis. In actual practice, however, it is quite common for a worker to put off or delay cleaning until a considerable amount of crusting has already occurred on the nozzle face plate. In any event, the mere action of wiping the nozzle plate with a cloth can actually aggravate the clogging or blocking problem since fibers or dirt from a cloth can enter the very small exit holes.

It is also known in the prior art to periodically spray ink through the ink jet exit openings even when no target object exists in an attempt to keep the ink jet exit openings clear. This strategy is largely unsuccessful in that clogging still occurs. Furthermore, ink is wasted.

DISCLOSURE OF INVENTION

The present invention relates to an apparatus and a method which relatively inexpensively, efficiently, and effectively cleans ink jet exit openings of an ink jet nozzle. This is accomplished without contact of the nozzle face plate by a wiping cloth or other article. Furthermore, the cleaning operation takes place automatically and periodically without positive steps having to be carried out by a worker.

The apparatus of the invention includes an ink jet nozzle for directing ink toward an object to apply ink indicia to the object. The ink jet nozzle includes a nozzle plate having an outer surface and a plurality of ink jet nozzle openings at the outer surface defined by the ink jet nozzle.

Ink supply means is provided for supplying ink to the ink jet nozzle and selectively expressing ink through the ink jet nozzle exit openings.

Solvent applicator means is provided for periodically applying liquid solvent to the nozzle plate outer surface at the ink jet nozzle openings to clean the ink jet nozzle openings.

The solvent applicator means includes a container having an interior for containing solvent. A solvent supply line extends from the container interior and has a dispensing opening located closely adjacent to the ink nozzle plate outer surface and the jet exit openings. Flow control means is provided for controlling the flow of solvent from the container to the ink jet exit openings through the solvent supply line.

Container mounting means is provided for mounting the container at a location elevated relative to the ink jet exit openings whereby solvent flows through the solvent supply line to the solvent supply line dispensing opening under the influence of gravity. The flow control means includes a valve for selectively establishing communication between the container interior and a solvent supply line dispenser opening.

Means is provided to vibrate the nozzle plate to promote downward flow of the solvent along the nozzle plate outer surface to the ink jet exit openings.

The method of the present invention is for cleaning ink jet nozzle openings of an ink jet nozzle for directing ink toward an object to apply ink indicia to the object. The ink jet nozzle has an outer surface and the ink jet nozzle openings are located at the outer surface.

The method includes the step of terminating passage of ink through the ink jet nozzle openings.

After the step of terminating passage of ink through the ink jet nozzle openings, a quantity of liquid solvent is flowed toward the ink jet nozzle openings.

At least some of the flowing quantity of liquid solvent is applied to the ink jet nozzle openings to clean the ink jet nozzle openings.

The step of flowing a quantity of liquid solvent toward the ink jet nozzle openings includes flowing the quantity of liquid solvent along the ink jet nozzle outer surface to the ink jet nozzle openings under the influence of gravity.

Other features, advantages, and objects of the present invention will become apparent with reference to the following description and accompanying drawings.

BEST MODE FOR CARRYING OUT THE INVENTION

Figure 1:
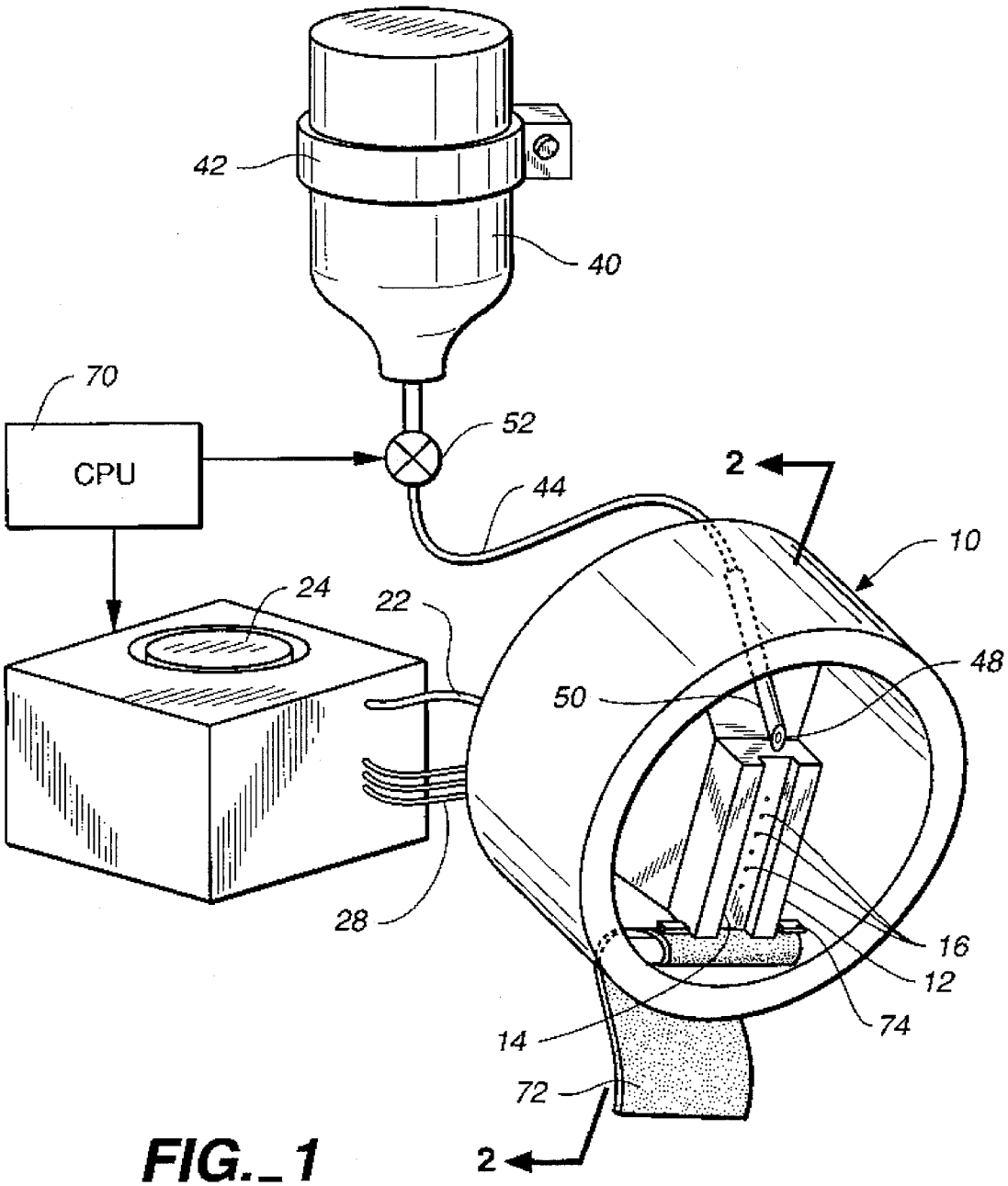
FIG. 1 is a somewhat diagrammatic, perspective view of apparatus constructed in accordance with the teachings of the present invention.

Referring now to the drawings, an ink jet nozzle of the type employed to apply a code or other ink indicia to an object is designated by reference numeral 10. The nozzle includes a nozzle plate 12 having an outer surface 14 and a plurality of exit openings 16.

Each of the ink jet exit openings 16 communicates with a passageway 18 formed in the body of the ink jet nozzle. Passageways 18 lead to and through a piezoelectric crystal array 20. As is well known in the prior art, a piezoelectric crystal in the array 20 is operatively associated with each of the ink passageways 18 and electrical energization of each piezoelectric crystal of a certain magnitude will serve to express ink through a particular passageway 18. It is of course to be understood that the ink pattern expressed from the nozzle will depend upon which of the piezoelectric crystals are energized.

In the interest of simplicity, and since structure of the foregoing type is well known in the art of drop on demand ink applicator systems, the precise structure has not been illustrated nor will it be described in detail. An example of an ink applicator system of the type just described in general terms is the PT88 PRINT HEAD made available by SIEMANS-NIXDORF PRINTING SYSTEMS, L.P., Boca Raton, Fla.

Ink is delivered to the passageways 18 to and through the piezoelectric crystal array 20 through an ink supply line 22 from an ink source such as that designated by reference numeral 24. The housing 26 for the container or ink source 24 contains the circuitry for controlling the activity of the piezoelectric crystals in array 20, also as is conventional. An electrical cable 28 extends from the control components (not shown) in housing 26 to the ink jet nozzle.

The structural components which serve to periodically deliver and apply liquid solvent to the nozzle plate outer surface 14 at the ink jet exit openings 16 include a container 40 having an interior for containing liquid solvent. Container 40 is to be mounted at any suitable location relative to ink jet nozzle 10 so that the container is elevated relative to the ink jet exit openings. Suitable mounting means such as attachment band 42 is utilized for this purpose.

Liquid solvent flows through a solvent supply line 44 leading from the interior of the container to a dispensing opening 48 defined by a plastic or metal tubular-shaped fitting 50 at the end of solvent supply line 44. A solenoid actuated on/off valve 52 is disposed within the solvent supply line and utilized as a control to selectively establish communication between the container interior and the solvent supply line dispensing opening 48.

Figure 2:
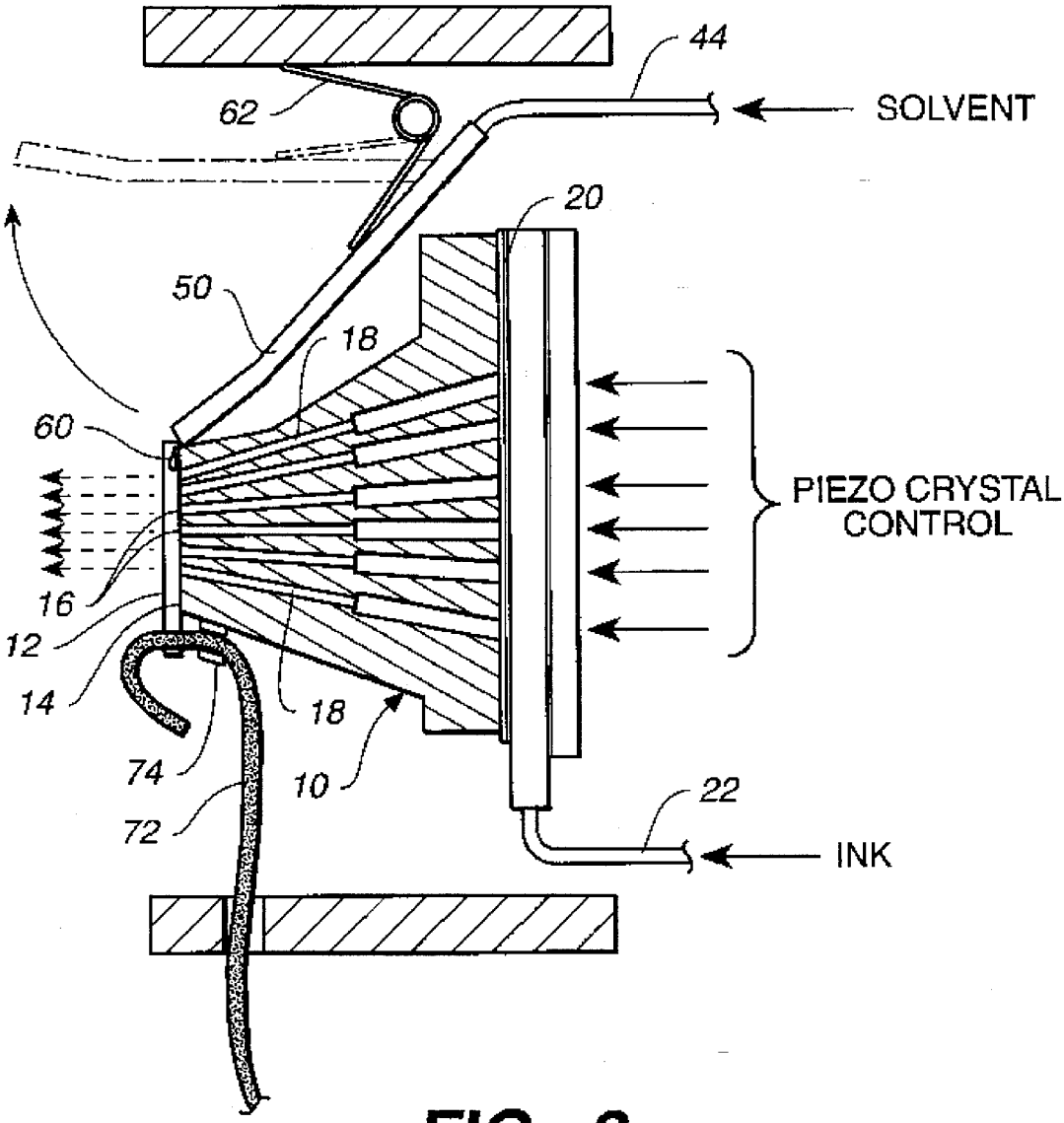
FIG. 2 is an enlarged, somewhat diagrammatic cross-sectional view taken along the line 2—2 in FIG. 1.

A quantity of liquid solvent exiting dispensing opening 48 will flow downwardly along nozzle plate 12 under the influence of gravity, the dispensing opening being closely adjacent to the nozzle plate outer surface and at a location elevated relative to the ink jet exit openings 16. FIG. 2 illustrates a dispensed quantity of liquid solvent 60 in the process of being applied to the outer surface 14 of the nozzle plate.

Preferably, fitting 50 is affixed to and mounted on a spring 62 which allows the fitting 50 to be manually displaced from the solid line position illustrated in FIG. 2 to the phantom line position, in the direction of the arrow. This arrangement allows for the servicing of the nozzle head without interference from the fitting 50.

It has been found that periodic application of liquid solvent of a conventional character along the nozzle plate outer surface so that it engages the ink jet exit openings will maintain the openings clean and unobstructed, this without the necessity of manually wiping the nozzle plate outer surface with a wiping rag or the like. A suitable solvent is ethyl alcohol.

It has been found that flow of the liquid solvent will be facilitated by imparting a vibration to the ink jet nozzle. This is suitably accomplished by energizing the piezoelectric crystals employed in array 20 with a lower degree of electrical energization than that employed when utilizing the piezoelectric crystals to express the ink through the passageways. For example, the piezoelectric crystal control can apply electrical energy to the piezoelectric crystals resulting in a vibration of 1,200 cycles per second to promote solvent flow.

A suitably programmed central processing unit 70 may be utilized to provide an input to the piezoelectric crystal control for this purpose. Also, the central processing unit 70 is operatively associated with valve 52 to periodically open and close the valve, it being understood that the central processing unit may be suitably programmed to vary the times between solvent dispensing applications dependent upon the conditions encountered.

In the arrangement illustrated, an absorbent cloth or paper sheet is disposed under nozzle plate 12 to absorb any excess solvent which may reach the bottom of the nozzle plate. The sheet of absorbent material is indicated by reference numeral 72. In the embodiment, a spring clip 74 releasably retains the paper sheet in position.

We claim:

1. Apparatus comprising, in combination:

an ink jet nozzle for directing ink toward an object to apply inked indicia to said object, said ink jet nozzle including a nozzle plate having a nozzle plate outer surface and a plurality of ink jet exit openings at said nozzle plate outer surface defined by said ink jet nozzle;

ink supply means for supplying ink to said ink jet nozzle and selectively expressing ink through said ink jet exit openings;

solvent applicator means for periodically applying liquid solvent to said nozzle plate outer surface at said ink jet nozzle openings to clean said ink jet nozzle openings, said solvent applicator means including a container having an interior for containing solvent, a solvent supply line extending from said container interior and having a distal end defining a solvent supply line dispensing opening located adjacent to said nozzle plate outer surface and said ink jet exit openings, and flow control means for controlling the flow of solvent from said container to said nozzle plate outer surface and said ink jet exit openings through said solvent supply line;

container mounting means mounting said container at a location elevated relative to said ink jet exit openings whereby solvent flows through said solvent supply line to said solvent supply line dispensing opening under the influence of gravity, said flow control means including a valve for selectively establishing communication between said container interior and said solvent supply line dispensing opening; and solvent supply line mounting means for mounting said distal end relative to said ink jet nozzle with said solvent supply line dispensing opening closely adjacent to said nozzle plate outer surface and at a location elevated relative to said ink jet exit openings whereby solvent dispensed from said solvent supply line dispensing opening will engage and flow along said nozzle plate outer surface to said ink jet exit openings, and said ink supply means including at least one piezoelectric crystal in operative association with said ink jet nozzle to express ink through said ink jet nozzle when said at least one piezoelectric crystal is electrically energized and crystal energizing means for selectively electrically energizing said at least one piezoelectric crystal to a level of energization lower than that required to express ink through said ink jet nozzle to vibrate said at least one piezoelectric crystal at a lower rate and vibrate said nozzle plate to promote downward flow of said solvent along said nozzle plate outer surface to said ink jet exit openings.

2. The apparatus according to claim 1 additionally comprising absorbent material mounted adjacent to said ink jet nozzle for receiving and absorbing excess solvent from said nozzle plate outer surface.

3. The apparatus according to claim 1 wherein said crystal energizing means is selectively cooperable with said at least one piezoelectric crystal to agitate ink within said ink jet nozzle.

4. The apparatus according to claim 1 wherein said nozzle plate outer surface is substantially planar and extends downwardly from said solvent supply line dispensing opening whereby solvent flow at least partially results from the influence of gravity.

5. The apparatus according to claim 1 wherein said supply line mounting means is adjustable and adjustably mounts said supply line to enable said solvent supply line dispensing opening to be moved between alternate positions relative to said ink jet openings.

6. The apparatus according to claim 1 additionally including timer means for adjusting the lengths of time between liquid solvent applications to said ink jet nozzle openings.

7. A method for cleaning ink jet nozzle openings of an ink jet nozzle for directing ink toward an object to apply inked indicia to said object, said ink jet nozzle having a nozzle plate outer surface and said ink jet nozzle openings being located at said nozzle plate outer surface, said method comprising the steps of:

terminating passage of ink through said ink jet nozzle openings;

after the step of terminating passage of ink through said ink jet nozzle openings, flowing a quantity of liquid solvent toward said ink jet nozzle openings;

applying at least some of said flowing quantity of liquid solvent to said ink jet nozzle openings to clean said ink jet nozzle openings, said step of flowing a quantity of liquid solvent toward said ink jet nozzle openings including flowing said quantity of liquid solvent along said ink jet nozzle outer surface to said ink jet nozzle openings under the influence of gravity; and vibrating said ink jet nozzle to promote the flow of said quantity of liquid solvent along said ink jet nozzle outer surface toward and past said ink jet nozzle openings, the step of flowing a quantity of liquid solvent toward and past said ink jet nozzle openings including passing said quantity of liquid solvent through a passageway and a restricted dispensing opening communicating with said passageway from a source of liquid solvent, and said vibrating step being accomplished by electrically energizing at least one piezoelectric crystal connected to said ink jet nozzle and employed to express ink through said ink jet nozzle when said at least one piezoelectric crystal is electrically energized to a level of energization lower than that required to express ink through said ink jet nozzle to vibrate said at least one piezoelectric crystal at a lower rate and to vibrate said ink jet nozzle at said lower rate to promote downward flow of said liquid solvent along said ink jet nozzle.

* * * * *